United States Patent [19]

Liljequist

[11] 4,428,197

[45] Jan. 31, 1984

[54] STIRLING MECHANICAL ARRANGEMENTS ESPECIALLY FOR DOUBLE-ACTING PISTONS

[76] Inventor: Jon L. Liljequist, 801 S. Elmhurst Ave., Mount Prospect, Ill. 60056

[21] Appl. No.: 322,361

[22] PCT Filed: Jul. 9, 1981

[86] PCT No.: PCT/US81/00924

§ 371 Date: Nov. 16, 1981

§ 102(e) Date: Nov. 16, 1981

[87] PCT Pub. No.: WO82/00688

PCT Pub. Date: Mar. 4, 1982

Related U.S. Application Data

[63] Continuation-in-part of Ser. No. 178,711, Aug. 18, 1980, abandoned.

[51] Int. Cl.[3] ..... F02G 1/04

[52] U.S. Cl. ..... 60/525; 60/517

[58] Field of Search ..... 60/517, 525, 526; 62/6; 123/63

[56] References Cited

U.S. PATENT DOCUMENTS 2,588,666 3/1952 Slemmons ..... 123/63

3,157,024 11/1964 McCrory et al. ..... 60/525

FOREIGN PATENT DOCUMENTS 468955 10/1950 Canada ..... 60/525

140156 2/1980 German Democratic Rep. .

*Primary Examiner*—Allen M. Ostrager

*Assistant Examiner*—Stephen F. Husar

*Attorney, Agent, or Firm*—Jon L. Liljequist

[57] ABSTRACT

Stirling engines (10; 150) and other Stirling devices especially of the type incorporating double-acting pistons (41; 168, 170) are simplified, more easily sealed, reduced in overall size and weight, and made easier to balance by mounting the crankshaft (45; 100; 110; 176) centrally within the gas enclosure housing (22, 23; 164, 166) such that it perpendicularly intersects the cylinders' sidewalls and skewers the pistons, thus eliminating the conventional outboard crankcase. Each crankpin or equivalent (46–49; 82; 104; 112; 178, 180) on the crankshaft is rotatably contained between the piston's endwalls and interacts essentially directly with that piston, thus eliminating the connecting rod normally located therebetween. A number of alternative lubricating arrangements are disclosed for lubricating crankshaft associated bearings including one wherein liquid lubricant is circulated through the crankshaft, and another wherein liquid lubricant is particulated and forcibly circulated around the crankshaft. This lubricant is isolated from contact with the working-gas either by static (200) or by dynamic (93; 140, 142) seals. Cooling optionally can be accomplished by circulating a gaseous coolant.

6 Claims, 9 Drawing Figures

FIG. 5
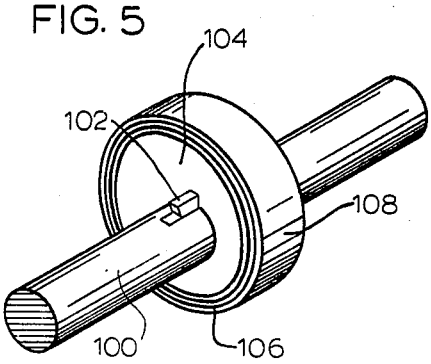
FIG. 6
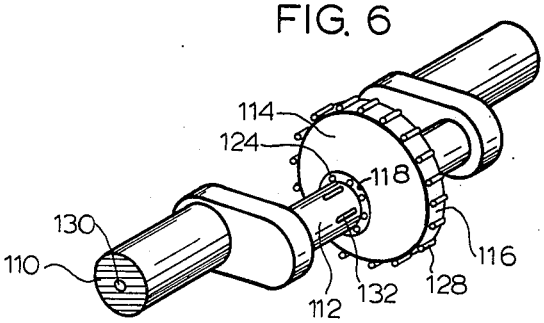
FIG. 7
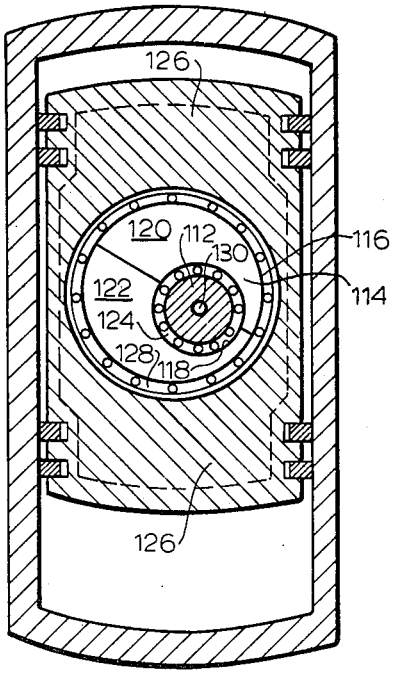
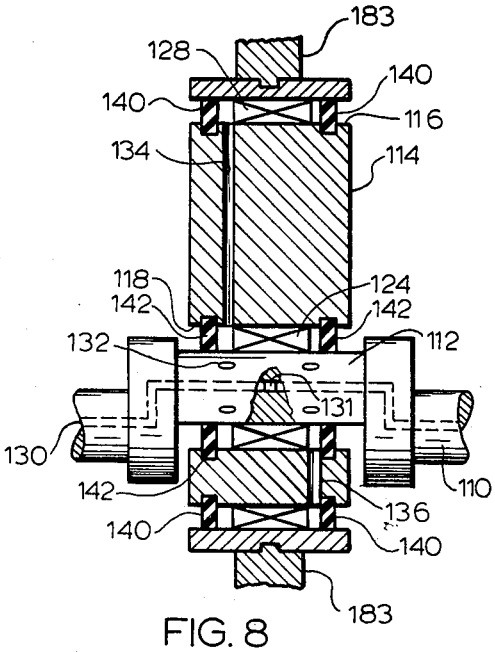
FIG. 8

STIRLING MECHANICAL ARRANGEMENTS ESPECIALLY FOR DOUBLE-ACTING PISTONS

RELATED APPLICATION

This application is a continuation-in-part of my copending application Ser. No. 178,711 filed Aug. 18, 1980 and entitled SIMPLIFICATION OF STIRLING CYCLE DEVICES, now abandoned.

TECHNICAL FIELD

This invention relates broadly to those machines or devices that incorporate the kinds of thermodynamic concepts involved in the engines developed last century and this century which are now frequently classified under the heading "Stirling" for Dr. Robert Stirling of Scotland. There unfortunately does exist at least some confusion over the breadth of the terms "Stirling engine" and "Stirling cycle", and therefore, the term "Stirling" however used hereinafter is intended in its broadest sense and thus contemplates all external combustion hot-gas engines (including the Ericsson variations) as well as cryogenic, refrigeration, heat pump, heart pump and any other devices operating on these or similar kinds of cycles.

BACKGROUND ART

Air engines reportedly date back to the late 17th century, but they did not appear in any significant numbers until after Dr. Robert Stirling patented his revolutionary concept in Great Britain in 1817. Thereafter, Stirling engines and variations thereof enjoyed some small degree of success for about a century until early in the 20th century when competition from electric motors and relatively lightweight internal combustion engines relegated the rather unwieldy Stirling engine into relative obscurity and what appeared would become irretrievable obsolescence.

Then, in about 1937, the N. V. Philips organization based in The Netherlands began development work on the Stirling concept, and by about 1958 they had succeeded in building a highly fuel efficient, single cylinder, experimental engine. Thereafter they developed a four cylinder Stirling engine variation utilizing double-acting pistons, and they installed it in a bus to investigate the feasibility of Stirling powered engines for vehicular purposes.

Since then, they and many other investigative teams have engaged in research and development activities to the ultimate end of employing Stirling devices in a variety of applications. Several small commercial devices have resulted, but none for vehicular purposes.

Research does continue, however, because Stirling engines would help solve many of today's environmental and energy concerns. Stirling engines can be made to operate relatively pollution free, they will operate on essentially any heat source or fuel capable of producing a sufficient temperature, they are potentially capable of achieving a higher thermal efficiency than internal combustion engines, and overall they can perform a wider variety of functions than most other prime movers. Today, more than ever before, there is a need for solving the problems that have kept the Stirling engine out of the marketplace.

Achieving a high thermal efficiency, and at the same time a reasonable power output per unit of engine weight, is accomplished by using a "working-gas" inside the cylinders that is highly pressurized. In very high performance devices this working-gas is preferably of high conductivity characteristics, as is helium, but hydrogen is generally preferred in automotive applications because it additionally is characterized by exceptionally low viscosity. And although any desirable fluid is difficult to contain at high pressures, hydrogen is particularly troublesome.

There has been some reasonable degree of success in containing the pressurized gas inside the cylinders or "working-gas enclosures", however the means of achieving this success add considerable bulk and mechanism to what originally was an unusually simple engine configuration. Bulk increases size and cost, while added mechanism increases cost and reduces reliability. And these factors combine to make current designs non-competitive with other and better known engines.

It was precisely this discomforting aspect of Stirling design that precipitated by copending patent application in the United States of America (Ser. No. 080,566 now issued as U.S. Pat. No. 4,253,303) entitled ENGINES, AND PARTICULARLY THOSE INCORPORATING THE STIRLING CYCLE filed Oct. 1, 1979. A corresponding application was filed under the Patent Cooperation Treaty (Serial No. PCT/US80/01281) on Sept. 30, 1980. These earlier disclosures teach basic concepts in sealing Stirling devices as well as reducing their size and weight. One important aspect therein involves moving all of the interconnecting mechanism between crankshaft and pistons to various locations physically within the confines of the working-gas enclosure, this comprising the expansion space, the compression space and any connecting passages or ducts therebetween. However, many modern Stirling devices of appreciable power rating (particularly engines) operate at such high internal temperatures that certain portions of the interconnecting mechanism (such as bearings) might be adversely affected by the extreme temperatures of the working-gas if not physically removed or separated from the working-gas enclosure or enclosures, or even forcibly cooled. Furthermore, it becomes more and more desireable to provide lubrication to bearings and bearing surfaces associated with the interconnecting mechanism as power rating increases. And when lubricants are employed on those bearing surfaces, the temperature of those lubricants must be held down.

High temperatures that interfere with lubrication and the seals for containing pressure have caused particular problems for that Stirling engine variation known as the "Franchot". The Franchot features a double-acting piston in each of two parallel cylinders, these pistons being interconnected by two crankshaft cranks phased 90° apart. The entrapped working-gas cannot travel to opposite sides of the piston in a given cylinder as there is no path to do so, but rather travels between cylinders. One end of one cylinder is interconnected with one end of the other cylinder, and the other ends of these two cylinders are similarly connected. One of the cylinders is so arranged that opposite ends thereof comprise both expansion spaces while opposite ends of the other cylinder comprise both compression spaces. The cylinder having both expansion spaces thus remains continuously hot, and the engineering problems incident to sealing and lubricating that cylinder and its mechanism have caused this innovative configuration to be virtually ignored for development purposes.

To make matters even more difficult, as engine power increases, more sophisticated heat transfer paraphernalia usually is employed. This heat transfer paraphernalia may include small diameter heat transfer tubes as well as regenerators housing a multiplicity of fine wires. It has been found that the working-gas will entrain lubricant to which it is exposed, and this lubricant will eventually work its way into and foul these tubes and wires so as to adversely affect heat transfer and the resulting efficiency of the engine. Thus, with high performance Stirling devices, particularly engines of significant power rating, lubricants are best isolated from the working-gas.

Much of the recent research and development efforts on the larger (and usually automotive oriented) Stirling power plants centers around that Stirling variation known alternatively as the "Rinia" or as the "Siemens". This design features four cylinders with a double-acting piston in each. By ducting the pressurized working-gas from the bottom of a first cylinder to the top of another cylinder, from the bottom of this second cylinder to the top of a third cylinder, from the bottom of this third to the top of a fourth, and from the bottom of the fourth back to the top of the first, and also by properly phasing the four cranks on the crankshaft (usually about 90° apart), the separate displacer pistons previously required are entirely avoided. Instead, each piston acts both as a power piston for its own cylinder and as a displacer for the working-gas for the cylinder with which it is interconnected. By alternating between displacer and power piston, the pistons of the Rinia never get as hot as the constantly hot piston of the Franchot, and the temperature of all four pistons therefore remains reasonably uniform. These considerations contribute to why the Rinia is preferred for automotive use. A more detailed treatment of the Rinia is not deemed necessary here because the Rinia's design and operation is thoroughly described in other readily available literature.

At least five large and well known organizations have worked or continue to work to make Dr. Stirling's concept a reality for vehicles. In 1978 the Ford Motor Company unfortunately terminated an exhaustive program under a cost sharing program with the U.S. Department of Energy. At least one of their designs was a Rinia square-four cylinder arrangement having connecting rods extending from connection with the double-acting power pistons inside the pressurized cylinders to a driven swashplate outside of the pressurized cylinders. Alignment of each piston and connecting rod combination was ensured at least in part by employing a crosshead between piston and swashplate. This approach consumes considerable room. Highly developed seals are used to contain the pressurized gas in each cylinder at the interface where the connecting rod extends through the cylinder endwall. But because of the relative reciprocation between connecting rod and endwall, sealing this dynamic interface has been particularly troublesome. Ford experimented with three sliding "dynamic" seals at each connecting rod interface, but the N. V. Philips development known as the "roll sock" is generally recognized as the best solution yet devised. The roll sock can be thought of as a flexible tube doubled over on itself which has one end affixed to the connecting rod and the other end affixed to the cylinder endwall. Being rigidly affixed at each end, it is in fact a flexible "static" seal rather than a "dynamic" seal, and this is a decided advantage in the sealing of hydrogen which has an uncanny ability to transgress sliding interfaces. Yet, the intricate design required to make use of this flexible static seal unduely increases the size and complexity of the resulting engine.

As is already known, much of this size and complexity can be avoided simply by pressurizing the crankcase. With the crankcase pressure elevated, the "blow-by" or transfer of gas from working-gas chamber to crankcase is not only diminished, but it becomes relatively irrelevant because the crankcase is sealed under these circumstances.

However, for engines of considerable power rating, Professor Graham Walker points out that a pressurized crankcase becomes a dominant fraction of the total engine weight, and thus this "simple expedient must be abandoned." (See *Stirling Engines* by G. Walker, specifically at page 119, Oxford University Press, 1980, ISBN 0-19-856209-8.)

Contributing to the above conclusion is the earlier mentioned fact that these larger Stirling devices usually incorporate not only sophisticated heat transfer paraphernalia, but also lubricants for lubricating bearings, and these lubricants must be isolated from the working-gas to avoid fouling the heat transfer tubes and regenerators. Thus, in the larger (and particularly automotive) applications, the seal between the working-gas chambers and the lubricated bearings best remains of the static seal type to ensure that absolutely no contact between working-gas and lubricants can occur. Any cyclic transfer of working-gas by way of blow-by past the pistons must in some way be kept isolated from that space containing lubricated bearings, particularly in sophisticated designs.

This background forms much of the basis for the design philosophy behind current Stirling programs for devices of significant power rating. Yet, the mechanical arrangements resulting from attempting to apply this background to new Stirling designs simply have not resulted in a marketed Stirling engine of significant power rating. Development does continue, but after about half a century since N. V. Philips began this new era of Stirling technology, one must consider that perhaps current designs are too heavily rooted in designs for other engines and thus contain inherent or fundamental weaknesses and problems for Stirling that a patchwork approach to solving cannot fully overcome.

DISCLOSURE OF INVENTION

This invention relates to new mechanical arrangements for Stirling devices that either simplify or avoid many of the difficult design problems currently encountered. Conventional connecting rods between power piston and crankshaft are eliminated, thus obviating any need for connecting rod seals. This also eliminates those difficult-to-balance connecting rod inertia forces. The crankshaft is relocated from an "outboard" position adjacent the cylinder bank to a central location to reduce the overall size of the device, yet permit the pressurization of the crankshaft passageway for even large Stirling devices without adding significant weight. Thoroughly enclosed and forced lubrication systems can be employed with dynamic seals that prevent contact between lubricants and working-gas, but where a static seal is deemed necessary therebetween for better isolation, a single static seal is employed even for multiple cylinder Stirling devices. Also shown is a system for circulating a lubricating mist as well as a variety of cooling systems for holding bearing temperatures down.

It is to be noted that the engine components of this disclosure (principally the crankshafts) that correspond with those defined in my U.S. Pat. No. 4,253,303 as "interconnecting means" are not herein contained in any part within this disclosure's working-gas enclosures or chambers; and also that this disclosure further differs by not incorporating any type of connecting "rod" between the crankshaft and any piston functioning at any time in the capacity of a power piston.

The above highlights only some of the major differences of this disclosure relative to other known constructions that result in advantages relative thereto. Other and more subtle advantages gained are woven throughout this disclosure in conjunction with discussion relating to specific embodiments, subassemblies and component parts.

The crankshaft in most known Stirling designs is normally located out beyond the end of the cylinder or cylinder bank. Herein the crankshaft or its equivalent intersects the cylinder sidewalls and skewers the pistons from a mounting passageway that interconnects the middles of the cylinders' sidewalls. The pistons are hollow with a longitudinal slot on opposite sides which permits the crankshaft to extend entirely through the piston, and those segments of the crankshaft that are wholly contained within the interior hollow of the piston each include a crank free to rotate within and relative to the piston. Regardless of whether the piston or the crankshaft is driving, rotation of the crankshaft accompanies reciprocation of the piston. This is achieved as follows. Rigidly contained within the hollow of each piston is a web lying in a plane that is perpendicular to the crankshaft axis. In one embodiment this web defines a transverse slot through which the crankpin extends, and together the crankpin and slotted web comprise a Scotch yoke mechanism. Depending upon the power rating of the device, there may or may not be a plain or antifriction bearing interfitted between crankpin and yoke. Regardless, the power transfer therebetween is essentially direct, and this eliminates any need for an intermediary connecting rod. Elimination of the connecting rod thus obviates connecting rod seals. The yoke inside the piston is held in proper angular alignment perpendicular to the crankpin axis by way of the slots on each side of the piston. These slots permit the piston to reciprocate relative to the crankshaft, as mentioned earlier, but the piston is restrained by interaction of the crankshaft in its side slots from pivoting around its own longitudinal axis. Because the piston is constructed of two identical halves, it is easily assembled over an entire crank station on the crankshaft. In devices of heavy power rating, the interconnection between piston and crankshaft may not fit entirely within the internal void or hollow within the piston, or even within the diameter of the cylinder, and in these instances the midportions of the piston and cylinder may need to be laterally expanded.

The interconnection between crankshaft and piston can take many different forms, and another embodiment shown herein comprises a circular "eccentric bearing" that is rotatably mounted in a correspondingly shaped hole in the piston's internal webs. This eccentric bearing has both an outer or peripheral bearing surface plus an eccentric inner bearing surface that fits around a crankshaft crankpin. Preferably the eccentricity of this inner bearing is equal to the throw of the crankpin. This reduces the overall dimensions of the piston-crankshaft interconnection. With this relationship the crank throw is only one-quarter of the piston stroke instead of one-half the piston stroke as it is in devices with either conventional connecting rods or Scotch yokes. Reducing the throw by one-half is helpful in attempting to fit the piston-crankshaft interconnection entirely inside the void within the piston, but that result is not necessarily assured thereby.

With both the Scotch yoke and the eccentric bearing the kinematic relationship between crankshaft rotation and piston reciprocation is truly sinusoidal. A search of the prior art has revealed a mechanism similar to the eccentric bearing in U.S. Pat. No. 947,233 issued in 1910 to H. C. Hammond of Great Britain, however that mechanism patent does not expressly contemplate its application to pistons, engines or Stirling devices.

Some designers may prefer to utilize the basic concept of this eccentric bearing, but in a two-to-one ratio of piston stroke to crank throw. This particular ratio can achieved by making the eccentric bearing eccentricity greater than the crank throw. This arrangement was also located in the previously mentioned prior art search, for example in U.S. Pat. No. 3,386,429 issued in 1968 to E. M. Trammell, Jr. The absence of compactness of the Trammell construction is apparent in his drawings, and his solution to what he describes as its "relatively large size" appears in his later U.S. Pat. No. 3,482,561 issued Dec. 9, 1969. This latter patent altogether abandoned what he termed as his "connector bearing" concept.

Another advantage of what has been herein described as an "eccentric bearing" over the earlier mentioned Scotch yoke resides in the fact that relative movement between eccentric bearing and piston is rotary, as is the relative movement between eccentric bearing and crankpin, whereas the relative movement between a crankpin and a Scotch yoke is inescapably that of relative reciprocation. Where bearing surfaces need to be lubricated, and where that lubrication must be sealed or isolated from the working-gas, the task of sealing is more easily accomplished where relative rotation occurs rather than where relative reciprocation occurs. Furthermore, the eccentric bearing also permits the transmitted load to be more widely distributed than the theoretical line contact of a basic Scotch yoke. Yet, for low power applications, the Scotch yoke retains the advantage of low cost.

Where lubricated bearings are desireable, and where power rating is low to moderate, the bearings can be pre-packed with lubricant and sealed. Sealed bearings can be purchased already pre-packed in the marketplace. In applications of greater transmitted power, it may be desireable to provide a continuous forced flow of lubricant to the bearings. Many such systems have already been developed for internal combustion engines, and some of those are certainly adaptable here, however a closed path system will be the first of two systems to be briefly described hereinafter.

Each crankshaft associated bearing requiring lubrication where relative rotation or relative oscillation is present is first sealed on each side. Then, a longitudinal center hole is provided throughout the length of the crankshaft such that lubricant forced into one end of the crankshaft would traverse the length of the crankshaft and exit from its other end if not intermediary exits were provided. But, at each longitudinally spaced bearing station where a forced flow of lubrication is desired, that center hole is in some way obstructed. These obstructions may also be provided at main bearing stations in addition to being centered in the center hole of each crankpin. Then, at each bearing station to be lubricated, the crankshaft is cross-drilled to each side of the obstruction, but inside the two seals that surround or contain the bearing so as not to be obstructed thereby. These cross-drillings can be so located as to lead to each side of the bearing or directly therein.

The crankshaft center hole at the "upstream" end of the crankshaft is connected by a closed fluid path (or a separate duct) to the crankshaft center hole at the "downstream" end of the crankshaft to form a closed loop. A lubrication pump driven by the crankshaft is interposed in the lubricant flow path along with other selected and desireable lubrication system components such as a reservoir, a lubricant cooler and a filter. The pump creates a differential pressure between its output and input sufficient to maintain fluid flow, but that pressure is not so great as to cause lubricant leakage across bearing seals. Lubricant is pumped into the upstream end of the crankshaft, flows downstream until it engages an obstruction at a bearing station, deviates out of the crankshaft through a cross-drilling immediately upstream of the obstruction, passes through the bearing to thereby lubricate it, re-enters the crankshaft by way of the cross-drilling immediately downstream of the bearing, and then continues downstream and similarly lubricates other bearings before reaching the downstream end of the crankshaft. From the downstream end of the crankshaft it is channeled back to the upstream end to once again begin its journey.

Preferably the entire closed lubrication system is thoroughly purged of all gases when being filled with lubricant. If gas were present in the closed system, fluctuations in crankshaft passageway pressure would vary the volume inside the closed lubrication system, and this would set up a pumping action tending to cause lubricant leakage. Without gas in that system, the seals also maintain a proper and uniform sealing contact.

Because of the essentially incompressible nature of liquids, and because the lubrication system is filled with liquid lubricant, the liquid volume of the closed lubrication system will not measurably change in volume responsive to variations in pressure in the crankshaft passageway. And, because of the inherent flexibility of the seals surrounding each bearing, any change in crankshaft passageway pressure is simply transferred across the bearing seals into the lubrication system. But because the internal pressure of the lubrication system tends to equalize throughout instantly, variations in internal pressure have essentially no effect on the lubricant pump which simply continues to produce the same pressure differential between its output and input as it did before. Therefore, approximately the same small pressure differential exists across the bearing seals regardless of the pressure in the crankshaft passageway.

Although the above described lubrication system is sealed, the seals used are uniformly of the type known as "dynamic seals" which are subject to wear and are less capable of containing pressurized gas than "static seals". Many current, high performance, experimental Stirling engines utilize flexible static seals interposed between the working-gas enclosures and the crankcase to prevent any possibility of the working-gas in the cylinders from being contaminated with lubricant by way of "blow-by" back and forth from crankcase to cylinder. One already mentioned solution to isolating the working-gas enclosure or enclosures from the crankcase is by incorporating what has become known as the "roll sock" because the roll sock is technically a static rather than dynamic seal. And so for those currently developing high performance engines, the dynamically sealed lubrication system disclosed hereinabove may not be currently acceptable.

However, the centralized crankshaft concept of this invention also lends itself particularly well to a second type or class of forced lubrication system. As with the roll sock arrangement, the system to be described also employs a flexible but static sealing means between the working-gas enclosures and that space containing critical bearings that require lubrication., yet there exists considerable difference in design philosphy as well as considerable differences in structure therebetween.

In brief terms, a single, flexible and fluted tubular sealing means extends longitudinally throughout the crankshaft passageway, it sealingly connects at each axial end into the cylinder block housing, and therebetween it connects sealingly into each double-acting piston in its path. This sealing means forms a separate internal space that houses the crankshaft and piston interiors, thus also housing all critical bearings, and this new space is herein termed the "crankshaft enclosure". This crankshaft enclosure comprises a portion of the crankshaft passageway, but it is sealingly separated from the rest of that passageway. Preferably the pressure on both sides of the sealing means is the same, but the gas used inside and outside the sealing means can be different if desired. Furthermore, with the bearings now statically sealed from the working-gas, lubrication systems consistent with those already developed for two-stroke-cycle and four-stroke-cycle engines and other devices become available alternatives.

As power rating increases, the need to cool critical bearing surfaces similarly increases. Where water circulated through the cylinder block is insufficient, and where lubricant coolers in the closed lubrication system described above are not adequate to hold down the operating temperature of critical components, then an auxiliary cooling system becomes a desirable option. This auxiliary cooling system circulates the gaseous medium already surrounding the crankshaft around a closed circuit which includes at least part of the crankshaft passageway as well as heat exchangers external of the cylinder block which dissipate the collected heat.

The available design alternatives of sealing, cooling and lubricating that this new centrally located crankshaft arrangement permits are numerous. Where no static sealing means creating a separate crankshaft enclosure is incorporated into the design, the designer has the option of using no lubricant, self lubricating bearing materials, pre-packed and sealed bearings, or some form of closed and forced liquid lubrication system. Coolant options available include circulating water, oil coolers and circulated enclosed gas.

Where the flexible static sealing means is employed so as to form a separate crankshaft enclosure, a wide range of lubrication systems becomes available, including some developed for non-Stirling devices. One yet to be described in detail utilizes some of the philosophy of those two-stroke-cycle systems where fuel and lubricant are mixed together and circulated around crankshaft bearings to lubricate them. When this system is used, bearings in the crankshaft enclosure are left open and exposed. The lubricant is finely dispersed into the gaseous medium circulating in the crankshaft enclosure.

Some of this gaseous medium with particulated lubricant therein circulates in, around and through the various bearings in this enclosure. Not unlike systems in some four-stroke-cycle engines, excess lubricant that collects in and around bearings drips down into a lubricant sump where a lubricant pump sends it back to the means that finely disperses it back into the circulating cooling gas.

In contrast with conventional Stirling designs having "outboard crankcases" (crankcases located axially outboard of the cylinder bank) which adds significant size and weight, the centralized crankshaft of this disclosure actually reduces size and weight both by eliminating connecting rods and by emplacing the crankshaft largely inside cylinders which already were designed for elevated pressures. Very little additional "beefing up" is needed for a centralized crankshaft in comparison to what is needed to add a pressurized "outboard" crankcase.

Numerous features have been mentioned and will be described later in detail. To show and describe all possible combinations of these features is not in the interest of brevity, yet to show and describe all features in a single embodiment is simply not feasible. But however combined, these teachings reduce size and thus cost, and for the most part they also simplify known Stirling designs. And when used in devices of appreciable power rating, the simple expedient of pressurizing the entire cylinder block including the space around the crankshaft need not be abandoned.

BRIEF DESCRIPTION OF DRAWINGS

FIG. 5 is a perspective view of another and alternative design for a crankshaft crank station.

FIG. 6 is a perspective view of yet another alternative design for a crankshaft crank station, this arrangement including a connector disc that forms the interconnecting means between crankshaft and piston.

FIG. 7 shows a cross sectional view of the connector disc arrangement of FIG. 6 taken transversely of the crankpin, and further including a piston in which the connector disc is mounted as well as a representative cylinder housing the piston.

FIG. 8 shows another and further enlarged view of the connector disc shown in FIGS. 6 and 7, this view also being in cross section but rotated 90° relative to the FIG. 7 view so as to show lubrication and sealing details therefor.

BEST MODE FOR CARRYING OUT THE INVENTION

Figure 1:
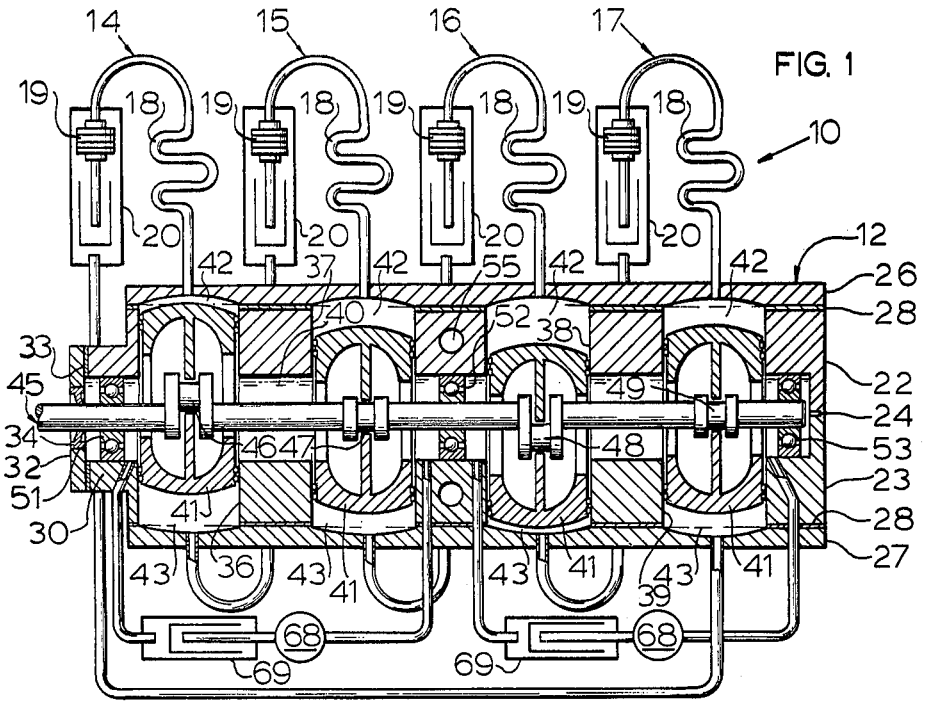
FIG. 1 is a substantially schematic, cross sectional view of an in-line (or straight-four), Rinia style, Stirling engine embodying many of the features and principles of the invention disclosed herein.
Figure 2:
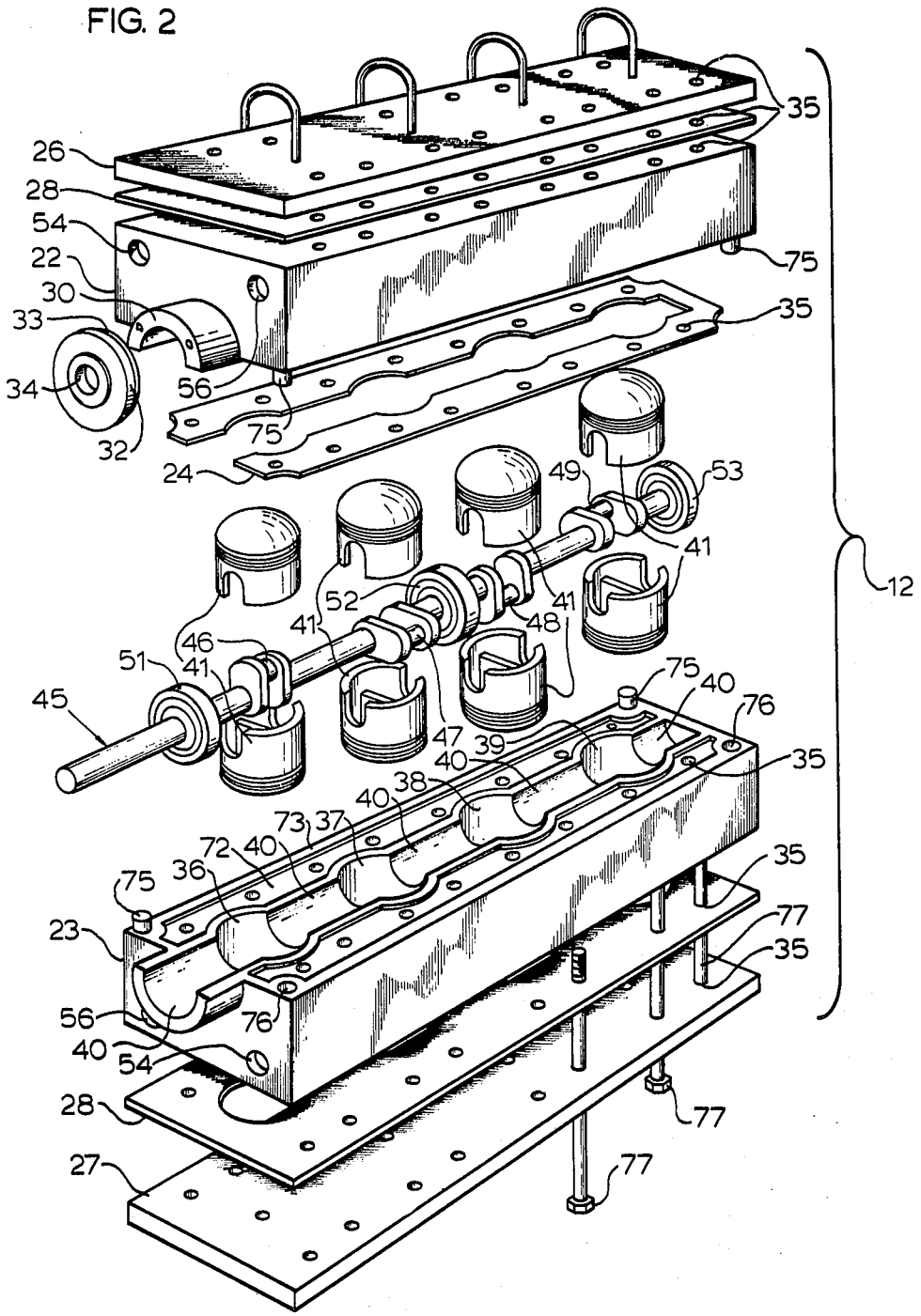
FIG. 2 is an exploded view in perspective of the engine block portion of the Stirling engine of FIG. 1 showing major components in their preassembled relative locations.

Referring first to FIGS. 1 and 2, and with particular reference initially to FIG. 1, there is shown a Stirling engine of Rinia configuration which is designated generally 10. Because modern Stirling engine design is exceedingly complex thermodynamically, with literally dozens of interdependent design variables of which many alone are critical to the engine's successful operation, these figures are principally simple line drawings to focus attention on specific aspects of the invention without distraction from details not pertinent thereto.

Engine 10 includes an engine block designated generally 12 of "straight four" or "in-line four" cylinder arrangement, and also four separate but substantially identical sets of heat transfer paraphernalia designated generally 14 through 17. Each set 14 through 17 includes heating means 18, regenerator means 19, and also heat dissipation means 20 all connected conventionally in series.

Except for the centralized location of the crankshaft passageway as well as the piston configuration and the interconnecting means between piston and crankshaft, the other details of the engine block design are a matter of design choice. However, a representative design will be discussed next primarily to satisfy the requirement of completeness of disclosure.

Engine block 12 includes upper and lower housings 22 and 23 with a static seal or gasket 24 therebetween (best seen in FIG. 2); upper and lower heads 26 and 27 affixed to housings 22 and 23 respectively with a static seal or gasket 28 between each housing and head; and affixed to the end 30 of the engine from which the crankshaft exits is an end cap 32 with a gasket 33 and the engine's only "external", pressure containment, dynamic seal 34.

A plurality of sixteen aligned bolt holes 35 (note FIG. 2) in each of the housings 22 and 23, in center gasket 24, in heads 26 and 27, and in both head gaskets 28 provide means for clamping the major stationary components of the engine together.

Housings 22 and 23 along with heads 26 and 27 together define internally thereof four identical sub-enclosures which could be of any shape, but which are shown here as conventional cylinders 36, 37, 38 and 39. Cylinders 36–39 are connected at their midportions by an elongate and generally cylindrical passageway 40. In many applications much of this passageway need have a diameter only slightly greater than that of the crankshaft it contains, however other applications will be seen to utilize this passageway to contain flexible static seals, and in those instances the passageway diameter must be significantly larger.

Each of the cylinders 36—39 contains a double-acting power reciprocator shown here as a cylindrically shaped piston 41, and although each piston 41 is preferably relatively long in comparison to its diameter to minimize side forces, it is also obviously shorter than the overall length of the cylinder containing it so as to divide that cylinder into a plurality of spaces including upper and lower, variable volume chambers 42 and 43 respectively.

Referring again specifically to FIG. 1, it will be seen that each heating means 18 leads directly into the top of the one chamber 42 while the heat dissipation means 20 of the same set of heat transfer paraphernalia leads into the bottom of a different cylinder's chamber 43, all of this being consistent with well known "Rinia" (or "Siemens") design philosophy. This arrangement eliminates separate displacers, as is well known, because each piston acts both as a power piston for its own cylinder and also as a displacer for the other cylinder to which it connected by gas transfer ductwork.

Each set of heat transfer paraphernalia and the two chambers 42 and 43 to which it is connected form an enclosure which contains an entrapped fluid. Herein the fluid is preferably a pressurized "working-gas", and the enveloping enclosure is thus a "working-gas enclosure".

Pistons 41 are phased in their movements relative to one another by interconnecting means shown here first in the form of a crankshaft designated generally 45 that extends longitudinally through the engine block in passageway 40. Crankshaft 45 has four crank stations. Each crank station includes a crankpin shown here as crankpins 46, 47, 48 and 49. When the crankshaft is viewed down its axis of rotation, these crankpins are seen to be offset about 90° apart. However, when the engine is assembled, each crankpin is contained substantially or entirely within a different one of the four pistons and is driven thereby. The combined action of all four pistons acting on the crankshaft drives it and any load connected thereto.

Crankshaft 45 is supported in passageway 40 by way of a plurality of bearings, here arbitrarily shown as three sets of ball bearings 51, 52 and 53. The specific number and type of bearing is a matter of design choice. Also a matter of design choice is whether or not cooling water will be circulated through the cylinder block, and provision therefore is shown in the form of ports or openings 54 leading into the cylinder block for circulating cooling water adjacent the crankshaft bearings (note the cored holes 55 in FIG. 1), and then that heated water exits the cylinder block by way of ports or openings 56 for later circulation through a cooling radiator (not shown).

Figure 3:
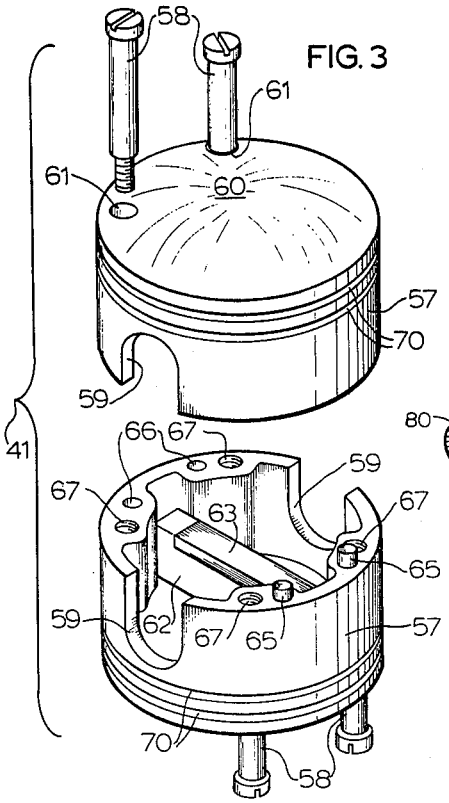
FIG. 3 is an enlarged and exploded view of one of the pistons contained within the engine block of FIGS. 1 and 2, but including additional details not shown therein.

Referring now to FIG. 3, pistons 41 include two major components which are here shown as identical halves 57 fastened together with a plurality of fasteners 58. Each half 57 includes a cylindrical sidewall slotted on diametrically opposite sides as at 59, an endwall 60 having two holes 61 therethrough for guiding fasteners 58, and also other structures forming interconnection means with and in conjunction with the crankshaft. These interconnection means take several shapes, but in this initial embodiment they include an internal web 62 recessed inside each half 57 and aligned perpendicularly to an imaginary line joining the centers of diametrically opposed slots 59. The width of slots 59 is only slightly larger than the diameter of crankshaft 45 in this embodiment, and the combined height of the two slots 59 in two mating halves is slightly larger than the diameter of the crankshaft plus the piston stroke. Thus, when two halves 57 are assembled over a crank on the crankshaft, the piston has ample play laterally of its cylinder to remain centered therein, and also at least as much play longitudinally as it requires for the piston stroke, however the fact that the crankshaft extends through narrow slots 59 prevents the piston from pivoting around its own longitudinal axis. Consequently, the webs 62 inside both piston halves remain perpendicular to the crankpin or its equivalent. Webs 62 are preferably cast integrally with the piston, or they may be separate pieces inserted later, but in any event it is desireable that at least the outer surface be of an abrasion resistant material or carry an abrasion resistant insert as at 63.

To ensure the exact alignment of the two piston halves each time they are fastened together, each half 57 includes a pair of locating pins 65 and a pair of closely mating holes 66. As will be understood, when the open ends of both halves 57 are facing one another with the pins 65 of each half opposite the holes 66 of the other half, the two halves will matingly interfit when brought together. The two halves can then be fastened together by way of fasteners 58 which extend through holes 61 in one half and which then screw into threaded holes 67 in the other half.

After two halves 57 are assembled together to form an entire piston 41, the abrasion resistant surfaces 63 of both halves are spaced apart a perpendicular distance which is only slightly greater than the outer diameter of a crankpin (or its equivalent) plus whatever bearings or other friction reducing devices might be assembled around it to reduce friction and wear. Webs 62 inside each piston comprise an internal and transversely oriented yoke through which the crankshaft crankpin extends. Together the crankpin and yoke interact so as to constitute "interconnection means" in the form of a Scotch yoke direct (or essentially direct) drive between piston and crankshaft, thus eliminating the conventional connecting rod normally interposed between piston and crankshaft.

The term "interconnection means" used above relates to the actual physical connection between piston and crankshaft. In some instances it includes bearings or comparable elements, and it is to be distinguished from the similar term "interconnecting means" used earlier herein and which is defined in my earlier cited patent as that which "interrelates the movement of the power reciprocator relative to the movement of the displacer means". Thus, in this application, the interconnecting means is simply the crankshaft.

Because of the centralized location of the crankshaft 41, various bearing surfaces between it and the pistons (as well as the main bearings) may require additional or auxiliary cooling beyond that afforded only by the circulation of cooling water alone through the cylinder block. Such an auxiliary system is described next.

Referring back to FIG. 1, auxiliary cooling means are shown that include a pair of blowers 68 for forcing a gaseous coolant longitudinally through passageway 40. Where, as here, the interconnection means comprises a Scotch yoke, this coolant finds passage across each cylinder in this embodiment through the piston yoke. In another embodiment, yet to be described, the coolant passes through openings put in the piston webs 62 for that purpose. Any number of cooling circuits can be used depending upon the degree of cooling desired, and FIG. 1 depicts one for cylinders 36 and 37, while another and entirely separate circuit is used for cylinders 38 and 39. Each circuit also includes a radiator 69 that is used to disperse heat collected in the engine. Each circuit is both closed and sealed to avoid leakage, and although the blowers are shown external of the cylinder block, in some applications it may be preferable to mount them directly on the crankshaft. Specifically, one blower 68 could be mounted in passageway 40 between cylinders 36 and 37, while the other blower 68 would be mounted between cylinders 38 and 39.

The coolant used in these two cooling circuits will usually be the same gas selected as the working-gas. Being under pressure in many design applications, and in some instances being selected because of its good conductivity, it will also be an excellent conductor for cooling those bearings associated with the crankshaft. However, even though it may be the same gas as selected for the working-gas, the gas in the crankshaft passageway is not technically "working-gas" for the purposes of this disclosure. By definition herein the "working-gas" is confined to the working-gas enclosures which includes only the working-gas chambers 42 and 43 as well as the interior space defined by the heat transfer paraphernalia 14–17 (or comparable spaces in other embodiments).

In this embodiment there is another advantage in having the crankshaft passageway gaseous coolant be the same gas as used in the working-gas enclosures. It is inevitable that some leakage or "blow-by" will occur around the pistons both into and out of the crankshaft passageway. Traditionally, blow-by is minimized by close tolerances between pistons and cylinder and by piston rings as at 70 in FIG. 3. But blow-by cannot be eliminated by these relatively practical means were gases of low viscosity are used at high pressure. This would be of no concern if no lubricants were used with crankshaft associated bearings, but the lack of lubrication causes excessive wear especially at higher power ratings, and wear is naturally of prime concern.

For very small Stirling devices, surface 63 can be of standard bearing material and operated essentially dry. As operating temperature and power rating increase, bearings of heat resistant and low friction materials such as ceramics or carbon graphites or even fluorocarbons are good choices where greases and oils are desireably avoided.

However, because engines of significant power rating normally require the continuous presence of lubrication around bearings, and because the more sophisticated heat transfer paraphernalia must be isolated from lubricants, lubricants will normally be necessary for crankshaft associated bearings, and that lubricant must be isolated from contact with any gas which in any way might work its way into the working-gas enclosures.

In some applications of the invention it is sufficient to provide bearings that are pre-packed with grease and sealed. This approach can be used both at the main bearings as well as at the interconnection means between piston and crankshaft. These kinds of arrangements will be discussed later in conjunction with FIGS. 4 and 5. For devices of significantly heavier duty, a continuously forced flow of lubrication is desirable, and several representative systems of forced flow lubrication will also be discussed later.

Before moving on to other figures, it is to be noted that the centralized location of the crankshaft affords other advantages in manufacturing. Housings 22 and 23 can be identical parts, heads 26 and 27 can be identical, piston halves 57 are identical and so are head gaskets 28. By viewing lower housing 23 in FIG. 2, it can be seen that middle sealing gasket 24 is sized to fit within a shallow recess 72 which is recessed relative to the uppermost and flat surface 73. Identical housing 22 includes a similar recess, and to ensure that both housings always align properly in assembly, surface 73 includes a pair of locating pins 75 and a pair of locating holes 76. Prior to final assembly, the two housings are preassembled without gasket 24 therebetween and machined. Bolts 77 (see FIG. 2) along with nuts (not shown) therefor clamp the housings 22 and 23 together temporarily while cylinders 36 through 39 plus passageway 40 are finish machined. In some applications separate heads 26 and 27 may be integral with the housings, but by being separate as here shown, the ability to remove them assists the finish machining of the cylinders because their absence permits the machining tool to pass entirely through the two housings and perfectly align the chambers 42 and 43 of each cylinder. Later, in final assembly, locating pins 75 and locating holes 76 ensure the same alignment as existed during machining. In a similar manner, the two halves of each piston are also preassembled apart from the crankshaft for ease of finish machining. After machining they are disassembled to prepare for their later final assembly onto the crankshaft.

It should perhaps be noted here that FIG. 1, being schematic in nature, shows an unusually long tube or duct leading from the bottom of the heat transfer paraphernalia 14 into the bottom of cylinder 39. In a real engine, of course, all corresponding tubes of the four cylinders would be arranged to be of similar length.

Figure 4:
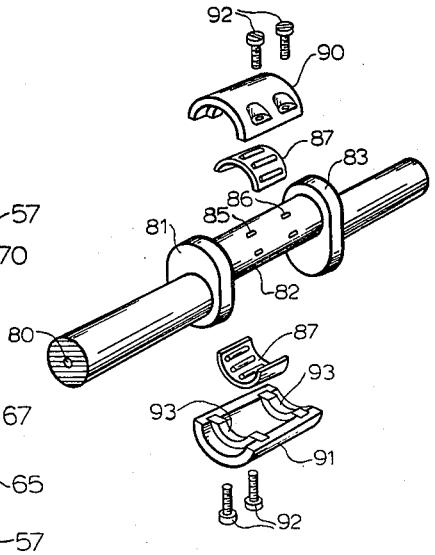
FIG. 4 is an exploded, perspective view of a single crank on a crankshaft such as that shown in FIGS. 1 and 2, however the crankpin is shown additionally including a bearing and bearing retainer, one of several friction reducing arrangements to be shown.

Moving now to FIG. 4, there is shown one crank station portion of a crankshaft that includes a low friction variation of the interconnection means which also includes the Scotch yoke mechanism. Also assisting in reducing friction is a forced liquid-lubrication system for lubricating bearing surfaces, and this system includes a center hole 80 in the crankshaft that extends longitudinally throughout the length of the crankshaft. This center hole also extends through crank arm 81, crankpin 82 and crank arm 83. A plug or other obstruction (not shown in FIG. 4) interrupts the center hole at the middle of crankpin 82, and that crankpin is cross-drilled to each side of the obstruction as at 85 and at 86.

Mounted around crankpin 82 are a full compliment of needle bearings 87 carried in a split cage. They and the Scotch yoke together comprise the interconnection means. The entire bearing assembly is held in place by a split bearing retainer consisting of halves 90 and 91. These halves are secured together over the crankpin such as by fasteners 92, and each half carries a pair of lubricant seals 93 which are spaced apart further than the distance between cross-drillings 85 and 86. When retainer halves 90 and 91 are assembled together over the crankpin, the outer diameter of that assembly is only slightly less than the perpendicular distance between the two yoke surfaces 63 inside an assembled piston. The assembled bearing retainer thus rolls over surfaces 63 to thereby reduce wear.

Needle bearings 87 are lubricated by pumping a liquid lubricant into the upstream end of the crankshaft by way of center hole 80. That lubricant travels downstream through the crankshaft until it encounters the obstruction at the middle of the crankpin. It then deviates out of the cross-drillings 85, passes through needle bearings 87 to thereby lubricate them, and then reenters the crankshaft by way of cross-drillings 86. When the lubricant is external of the crankshaft during its movement from cross-drillings 85 to cross-drillings 86, it is retained in the closed lubrication system by way of retainer seals 93. Although only one bearing station is shown in FIG. 4, the crankshaft is in fact cross-drilled at every bearing station to be lubricated (including main bearings if desired), and each bearing station is appropriately enclosed with lubricant seals to maintain the totally enclosed integrity of the lubrication system. A stationary, lubrication return line (not shown in FIG. 4) interconnects the two ends of the crankshaft, and this return line may include such lubrication system components as a pump and filter as well as perhaps a reservoir and lubricant cooler.

In light duty applications, the center hole 80, the cross-drillings 85 and 86, and return line with lubrication system components are eliminated. Needle bearings 87 are instead pre-packed with grease which is held inside the bearing retainer by means of bearing retainer seals 93.

FIG. 5 shows an alternative form of crank station that simplifies both crankshaft design and manufacture. This crankshaft simply comprises a straight shaft 100 with a keyway slot milled therein at each crank station for a key 102. A cam 104 in the shape of a circular disc with an eccentric hole therethrough is keyed by way of key 102 to the crankshaft. Circular cam 104 is driven in much the same manner as the crankpins described in FIGS. 1–3, and the stroke of the piston is simply double the eccentricity of the eccentric hole in the circular cam through which the crankshaft extends. To reduce abrasion between the cam's circular periphery and the piston yoke, a standard pre-packed and sealed antifriction bearing 106 is fitted over the cam's peripheral surface so that the bearing's outer race 108 will roll back and forth over surfaces 63 instead of sliding thereover.

FIGS. 6, 7 and 8 focus on a different type of connection between crankshaft and piston. Herein these antifriction interconnection means lend themselves both to compactness and acceptable load distribution relative to the antifriction interconnection means shown in earlier described figures. Additionally, all bearing surfaces can optionally be either force lubricated or pre-packed and sealed. And again, as before, only a small portion of the entire crankshaft is shown, and it is here designated 110. Crankshaft portion 110 includes a crank station having a crankpin 112. Mounted on crankpin 112 is what is herein termed on eccentric bearing 114 having a circular periphery 116 and an eccentric hole 118 therethrough that rotatably accepts crankpin 112. The eccentricity of hole 118 can be either greater than, or equal to, the crank throw. When equal, the crank throw is one-quarter the piston stroke; and when greater, it is one-half the piston stroke.

In most applications the eccentric bearing 114 will include two identical halves 120 and 122. These two halves clamp together around crankpin 112 and include a sealed bearing 124 or bearing surface therebetween. The outer circular surface of the eccentric bearing rotatably mounts in a pair of piston webs 126 which are shaped differently than the piston webs 62 of FIG. 3. Instead of including flat and parallel surfaces as at 63 in FIG. 3, webs 126 are each semicircularly recessed so that when two piston halves are brought together, the webs 126 therein form a large circular hole for holding the eccentric bearing (see FIG. 7). Carried between the outer surface of the eccentric bearing and the piston webs 126 is a sealed bearing, shown here as a full compliment of needle bearings 128, permitting either relative rotation or relative oscillation between eccentric bearing 114 and the piston. Where the crank throw equals the eccentric bearing's eccentricity, relative rotation occurs; and where the eccentricity is greater, relative oscillation takes place.

Bearings 124 and 128 can be either pre-packed and sealed, or they can be force-fed with a liquid lubricant traversing a closed path as was discussed with FIG. 4. Liquid lubricant pumped through the crankshaft center hole 130 confronts obstruction 131 and thus deviates out of cross-drillings 132. A lubricant passage 134 in one half of the eccentric bearing carries at least some of this lubricant to outer bearing 128 to lubricate it, and from there it is routed either back through inner bearing 124 or directly to cross-drillings 138 by way of another passage 136 for re-entry into the crankshaft center hole. Flow is controlled by passage size and baffling to maintain a proper balanced flow of lubricant to the two bearings. Seals as at 140 spaced to each side of outer bearing 128, and seals 142 located to each side of inner bearing 124, contain the lubricant to avoid its exposure to gas in the crankshaft passageway that might later work its way into the working-gas chambers and foul heat transfer.

Figure 9:
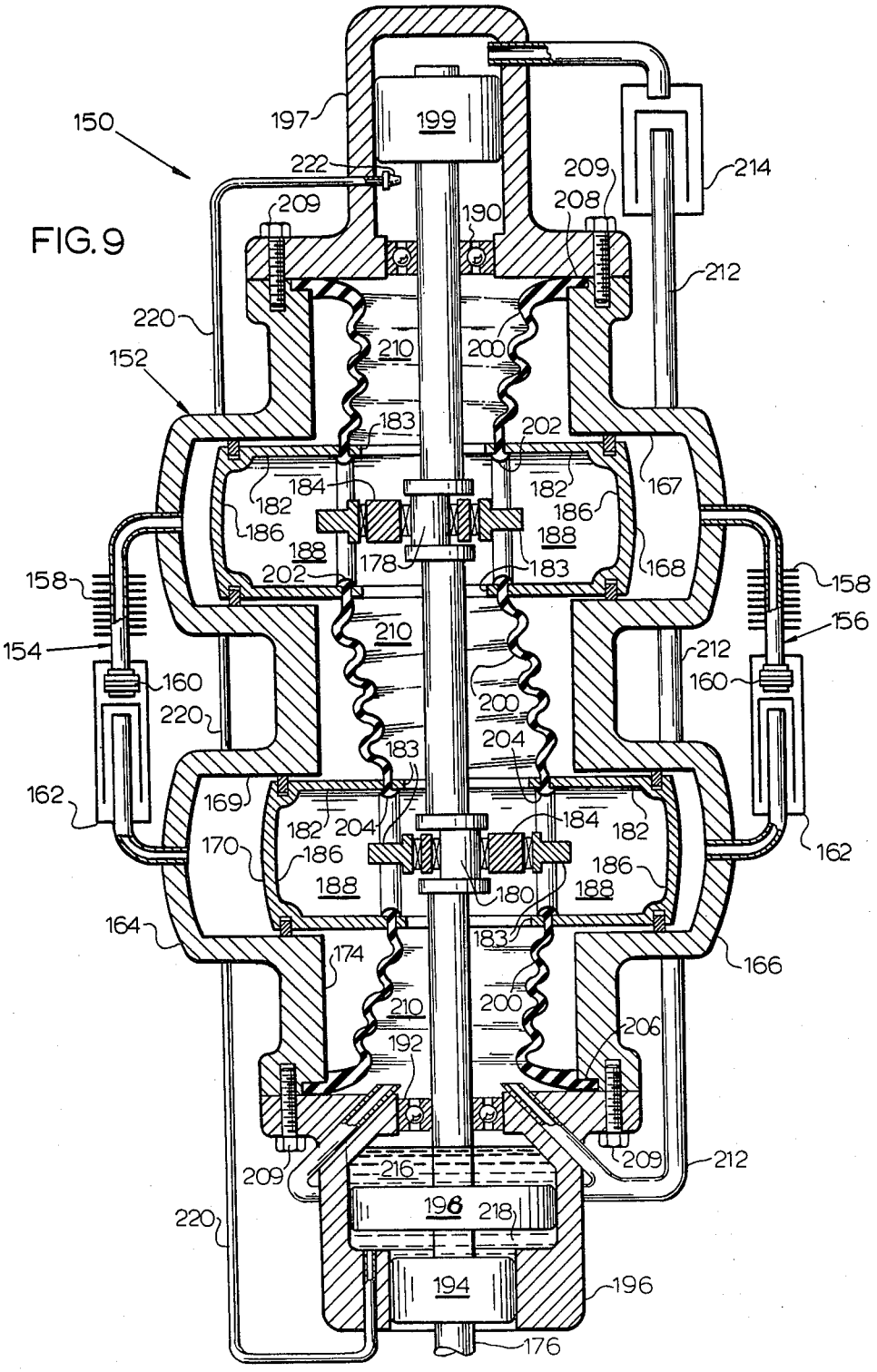
FIG. 9 is a cross sectional view, largely schematic, of a Franchot style Stirling engine also embodying many of the details of the present invention, this particular figure also showing an optional static seal arrangement for isolating the crankshaft passageway from the working-gas enclosures.

FIG. 9 is a somewhat simplified cross sectional view of a two cylinder Franchot style Stirling engine here designated generally 150. This engine includes a cylinder block designated 152 and two sets of heat transfer paraphernalia shown generally at 154 and 156. Each set of heat transfer paraphernalia includes heating means 158, regenerator means 160 and cooling means 162, these latter three components all being conventionally connected in series.

Cylinder block 152 includes a pair of housings 164 and 166, which when assembled, together define internally a first horizontal cylinder 167 containing a first hollow piston 168, a second horizontal cylinder 169 containing a second hollow piston 170, and also a vertically oriented crankshaft passageway 174 that intersects the middles of the two cylinders. This vertical alignment of horizontal and parallel cylinders is frequently used in those marine engines designed for outboard attachment to boats, and as will be seen, this orientation is of particular value when the lubrication system yet to be described is employed.

Mounted in the crankshaft passageway is a vertical crankshaft 176 having two crank stations and a pair of crankpins 178 and 180 arranged out of phase by the conventional Franchot 90°. Crankpin 178 is contained in the hollow of piston 168, and crankpin 180 is contained in the hollow of piston 170. Each of these two pistons is constructed of four parts of which there are two identical outer portions 182 and two smaller but also identical inner portions 183. Inner portions 183 include the side slots through which the crankshaft 176 extends, and they also include semicircularly sculptured internal webs (similar to the webs 126 in FIG. 7) for supporting interconnecting means in the form of an eccentric bearing 184. Each piston web need not necessarily extend axially to the piston endwall (here designated 186), and when it doesn't, it leaves space 188 through which gaseous coolant can flow when that manner of cooling is incorporated into the design.

Crankshaft 176 is rotatably supported in passageway 174 by at least a pair of main bearings 190 and 192. The lower end of the crankshaft exits the cylinder block through a rotary dynamic seal 194 sealingly emplaced in an end casting 196, while the upper end of the crankshaft passageway is sealed off by way of another end casting 197. A lubricant pump 198 encircles the crankshaft at its inner and lower end, and a blower 199 encircles the crankshaft at its upper end. Portions of both the pump and the blower are driven by the crankshaft to effect fluid movement.

To eliminate any possibility of lubricant in the vacinity of the crankshaft from contacting and contaminating even that small amount of the working-gas that might leak back and forth across the piston rings, static but flexible sealing means surround the crankshaft to statically seal and isolate the crankshaft from those spaces where the working-gas might gain access. Currently preferred is a static but flexible sealing means in the form of a fluted, tubular element 200 which is carried within crankshaft passageway 174 and which is generally axially oriented therewith. As will be more thoroughly described shortly, sealing means 200 is sealingly affixed to both pistons, and to this end the sealing means has two transverse holes therethrough, each being axially aligned with a different one of the two cylinders. To facilitate a hermetic connection between the sealing means and each piston, each transverse hole is a little smaller in diameter than the diameter of the piston extending therethrough to provide edge material for clamping. The upper transverse hole is defined by two such edges 202, and the lower transverse hole is defined by another pair of edges 204. Edges 202 are clamped between piston portions 182 and 183 of piston 168, while edges 204 are clamped between piston portions 182 and 183 of piston 170.

Assembly of pistons and sealing means together is achieved as follows. First, eccentric bearings 184 and inner portions 183 of the pistons are assembled around the crankpins 178 and 180, and they are rotatably secured thereto with fasteners (not shown). Next, sealing means 200 is slipped axially over the end of the crankshaft until the two transverse holes of the sealing means align axially with piston portions 183 now around the crankpins. Then outer portions 182 of the two pistons are positioned and aligned externally over sealing means' edges 202 and 204, and finally the four piston portions 182 are fastened into piston portions 183 axially with screws which causes edges 202 and 204 of the sealing means to be sealingly clamped between piston portions 182 and 183. This subassembly is then ready for assembly into the cylinder block.

In most applications the sealing means 200 will be molded of an elastomeric material such as one of the newer and more heat resistant plastics. Thus, the material of the sealing means itself acts as its own gasket when it is compressively clamped between piston portions 182 and 183. Where the material selected for the sealing means 200 is not particularly resilient, as in the case of metal, the interface between the sealing means and piston portions 182 are preferably gasketed.

No single design for the sealing means 200 will be best for every application or for every material from which it is constructed. Thus, specific design details for sealing means 200 are left to the individual designer and his or her specific project. However, it should be noted that the transverse reciprocation of longitudinally spaced cross sections will likely impose particularly severe stress conditions on many materials. It is therefore suggested that special design consideration be given especially to those portions of the sealing means both adjacent its connection with each piston as well as adjacent its connection into housings 164, 166 at its extreme axial ends. These areas of high stress should preferably be modified with additional stress relieving contours. For example, those areas surrounding circular edges 202 and 204 can carry concentric flutes that encircle the pistons in a manner similar to an apertured diaphragm. This enhances the flexibility of the sealing means at the highly stressed connection. A variation of this theme would be to make the tubular bulk of the sealing means relatively stiff so that most or all of the diaphragmed areas encircling the pistons do substantially all of the flexing.

Each axial end of sealing means 200 is sealed into housings 164, 166 to effectively isolate the piston interiors and crankshaft from the rest of the crankshaft passageway. Specifically, the lower end of the sealing means (as seen in FIG. 9) comprises an annular flange that is compressed in a fixed-thickness slot 206 formed between housings 164, 166 and end casting 196; while the upper axial end of the sealing means is similarly compressed in a fixed-thickness slot 208 between housings 164, 166 and end casting 197. This fixed width is slightly less than the uncompressed thickness of the resilient annular flange so that a proper holding and sealing compression is achieved when the flanges of the end castings are fully drawn up by bolts 209 so as to come into contact with the metal of housings 164, 166. Sealing means 200 therefore acts not only to isolate this newly formed crankshaft enclosure, designated 210, from the rest of the crankshaft passageway 174, but it further acts to statically seal both spaces in the crankshaft passageway from the environment external to the cylinder block. To prevent injurious distortion of the sealing means 200, the pressure both inside and immediately outside the sealing means is maintained essentially equal by a pressure equilization system not shown.

Blower 199 circulates the gaseous medium inside enclosure 210 downwardly and across all surfaces inside enclosure 210. Near the bottom of enclosure 210 this gaseous medium enters ductwork 212 that carries it back to the top of that same enclosure. Duct 212 may be directed through an external heat exchanger 214 for removing heat from the gas where the need for cooling exists.

With the crankshaft enclosure 210 statically sealed relative to the rest of the crankshaft passageway 174, it is no longer critical that lubricant in and around various crankshaft bearings be sealingly contained within sealed bearings as was shown in earlier described embodiments. Sealing means 200 provides adequate lubrication isolation entirely by itself. Thus, lubrication systems already developed for and conventional in internal combustion engines may now also be employed in this Stirling arrangement. One hybrid form of such a system is described next.

As FIG. 9 shows, main bearings 190 and 192 are not individually sealed. Thus, the circulating gas inside crankshaft enclosure 210 is free to circulate through and around those bearings, as well as through bearings 184.

Liquid lubricant is introduced into the crankshaft enclosure 210 where it collects in a sump 216 at the bottom of the enclosure immediately above pump 198. Pump 198 takes in lubricant from this sump, pressurizes it, and then emits it pressurized into a reservoir 218 therebelow. This lubricant travels up a line 220 from reservoir 218 to a nozzle 222 at the top of the crankshaft enclosure where it is emitted as finely dispersed particles into the downwardly moving gaseous medium. This particulated lubricant is carried by the gaseous medium around and through the various bearings inside the crankshaft enclosure, and it deposits thereon in a manner not unlike that system used in many two-stroke-cycle engines where lubricant is mixed with the fuel and circulated through the crankcase.

In order for this embodiment to accommodate sealing means 200, the crankshaft passageway diameter must be somewhat relatively larger than the comparable diameter of the embodiment of FIGS. 1 and 2, yet overall engine size remains considerably less than where the crankshaft is located conventionally beyond the end of the cylinders. And although the sealing means 200 may not be needed in some Stirling applications, its presence does afford another advantage in that a different gas can be used in the crankshaft enclosure than is used as the working-gas in the working-gas enclosures.

Hydrogen and helium are particularly desireable working-gases, but one might prefer to use air in the crankshaft enclosure. Not only would air be easier to contain by dynamic seal 194, but hydrogen embrittlement inside the crankshaft enclosure is avoided. Of course, this particular embodiment shows lubricant adjacent seal 194, and this is even easier to contain than air.

Certainly other forms of sealing means can be used to create a hermetically isolated crankshaft enclosure, including the already highly developed roll sock. Two roll socks per piston could be conventionally installed.

Before leaving FIG. 9, it should be noted that the cylinder block is shown including two identical housings 164 and 166. Some designers may prefer that a single casting be substituted for these to parts to facilitate machining and pressure sealing. In this case each cylinder would also include one or two heads.

All of the preceeding discussion relating to all of the figures shows and describes a variety of alternative designs and features. It is intended that these variations are largely interchangeable. And although the two devices selected to illustrate the inventive concepts both happen to be engines, this is primarily because of the current emphasis on cleaner, non-polluting prime movers. All of the principles described above are equally applicable to devices other than engines as well.

The various figures described are believed sufficiently detailed to enable those skilled in this art to reasonably readily employ at least some aspects of these teachings into their own detailed designs, but these teachings have deliberately not included every detail of construction, particularly where such details are in no way germane to what is new herein. For example, neither flywheels nor gas replenishment means nor engine starting systems nor combustion chamber details have been shown. These components, though certainly necessary to many prime movers, are adequately covered in other literature and would only unduely lengthen this document without enhancing an understanding of what is new and inventive.

Inferences should not be drawn or implied relative to the intended breadth of this invention merely because the various figures incorporate similarly appearing components. Devices which look very much different than what is shown herein could very well capture the spirit of these teachings and thus fall within the invention's scope. The true breadth of the invention is therefore not to be determined by the drawings selected to represent the invention, but rather by the language used in the claims when given its broadest reasonable interpretation.

INDUSTRIAL APPLICABILITY

Stirling devices have already undergone considerable development for vehicular power, heat pumps, heart pumps, refrigeration and cryogenic devices, electrical generators and so forth. United Stirling of Sweden has even published an "Application Plan" that compares the feasibility of Stirling technology in a variety of markets, thereby creating a flow chart for systematically entering these new markets in a logical sequence. Their plan charts numerous applications including compressors, submarines, solar energy conversion devices and farm machinery. We are now only at the forefront of this frequently perplexing and frustrating technology.

Industrial interest thus far has been restrained because of, to a large degree, the cost of manufacturing those known designs already developed or in development. Designs that reduce cost will pave the way to a myriad of other applications including such things as household appliances, camping and recreation devices, kitchen aids and sports oriented products as well as others not yet conceived.

Many relatively small internal combustion engines are now used to power lawn care equipment, small boats, tree cutting devices, small generators and other items. In the future these products may very well be powered with Stirling engines. Because double-acting Stirling pistons have some distinct design advantages, Rinia style designs will certainly be considered, but a four cylinder engine is not likely to be competitive costwise with a single cylinder internal combustion engine. However, a two cylinder Franchot constructed in accordance with the teachings of this disclosure may very well compete costwise.

Finally, as industry (particularly the electricity generating industry) replaces old and worn out equipment, they would be well advised to replace that equipment with engines capable of operating on a variety of fuels, not only those heavily dependent on our depleting gas and oil.

I claim:

1. In a multiple cylinder Stirling engine that includes an engine block defining a first and second cylinder, said first cylinder including a first double-acting piston that acts at least in one direction as a power piston, said second cylinder including a second piston that acts at least in one direction as a displacer, a crankshaft passageway extending perpendicularly to the movement of the pistons and located generally centrally of the engine block, and a crankshaft disposed in said crankshaft passageway and rotatably mounted in said block, said crankshaft extending from inside said crankshaft passageway to the environment external of said block through a dynamic seal interposed between the block and the crankshaft, the improvement comprising:

said pistons being hollow with side entrances therein through which the crankshaft extends;

substantially direct interconnection means between said power piston and said crankshaft in a form other than that of a conventional and elongate connecting rod;

and static sealing means surrounding said crankshaft and flexibly connected to the pistons to form a separate crankshaft enclosure as part of the crankshaft passageway, said static sealing means being statically connected to the block so that those portions of the crankshaft passageway not included within the crankshaft enclosure are isolated from the environment external of said block by way of static rather than dynamic sealing means.

2. In a Stirling device, said device defining internally thereof at least two pair of working-gas chambers designed to withstand elevated internal pressure, each working-gas chamber containing a pressurized working-gas that travels back and forth generally between itself and another chamber, said device also including a piston separating the working-gas chambers of each of said pair, the piston of one pair of working-gas chambers being double-acting and operating in at least one direction as a power piston whereas the piston of the other pair of working-gas chambers operates in at least one direction as a displacer, the improvement being characterized by:

said double-acting piston includes two endwalls rigidly connected together with a void therebetween, said void defining a significant portion of a crankshaft passageway which extends transversely through said double-acting piston;

a crankshaft extending transversely of said double-acting piston and into said void, said crankshaft being mounted in said device for rotation in said crankshaft passageway relative to said double-acting piston;

sealing means between said crankshaft passageway and the environment external of said device for containing gas under pressure within the crankshaft passageway;

flexible but static sealing means rigidly attached both to at least one of said double-acting pistons and to other portions of said device to thereby create a separate crankshaft enclosure for hermetically isolating the crankshaft from the rest of the crankshaft passageway;

and interconnection means both on that portion of the crankshaft disposed within said void and also forming a part of said double-acting piston for transfering power substantially directly therebetween without a conventional connecting rod.

3. The Stirling device of claim 2 wherein said interconnection means comprises an eccentric bearing having a circularly shaped outer periphery and an offset hole therethrough, said eccentric bearing being entirely contained within the periphery of said piston.

4. The Stirling device of claim 3 wherein the eccentricity of the offset hole is one-fourth the stroke of the double-acting piston.

5. The Stirling device of claim 2 including blower means for circulating gas transversely through at least one piston.

6. The Stirling device of claim 5 including means for injecting finely disbursed lubricant into the circulating gas for lubricating the interconnection means.

* * * * *